United States Patent [19]

Gaskell

[11] Patent Number: 4,616,781

[45] Date of Patent: Oct. 14, 1986

[54] FUEL INJECTION NOZZLES

[75] Inventor: David J. Gaskell, Sudbury, England

[73] Assignee: Lucas Industries Public Limited Company, Birmingham, England

[21] Appl. No.: 607,240

[22] Filed: May 4, 1984

[30] Foreign Application Priority Data

May 19, 1983 [GB] United Kingdom ..... 8313904

[51] Int. Cl.[4] ..... F02M 55/00

[52] U.S. Cl. ..... 239/124; 239/533.4

[58] Field of Search ..... 239/533.2–533.12, 239/584, 124

[56] References Cited

U.S. PATENT DOCUMENTS

| | | | |
|---|---|---|---|
| 2,374,614 | 4/1945 | Nichols | 239/533.8 X |
| 3,425,635 | 2/1969 | Guertler | 239/533.3 X |
| 3,430,866 | 3/1969 | Guertler | 239/533.3 |
| 4,258,883 | 3/1981 | Hofmann et al. | 239/124 |

*Primary Examiner*—Andres Kashnikow

[57] ABSTRACT

A fuel injection nozzle for supplying fuel to a compression ignition engine includes a valve member movable against a spring to allow fuel flow through an outlet from a fuel inlet passage. The valve member is actuated by the pressure of fuel and the nozzle includes a flow path extending from said inlet passage to a drain. The flow passage includes a variable restrictor defined by a port and the valve member, the degree of restriction to the flow of fuel increasing as the valve member moves against the action of the spring.

1 Claim, 1 Drawing Figure

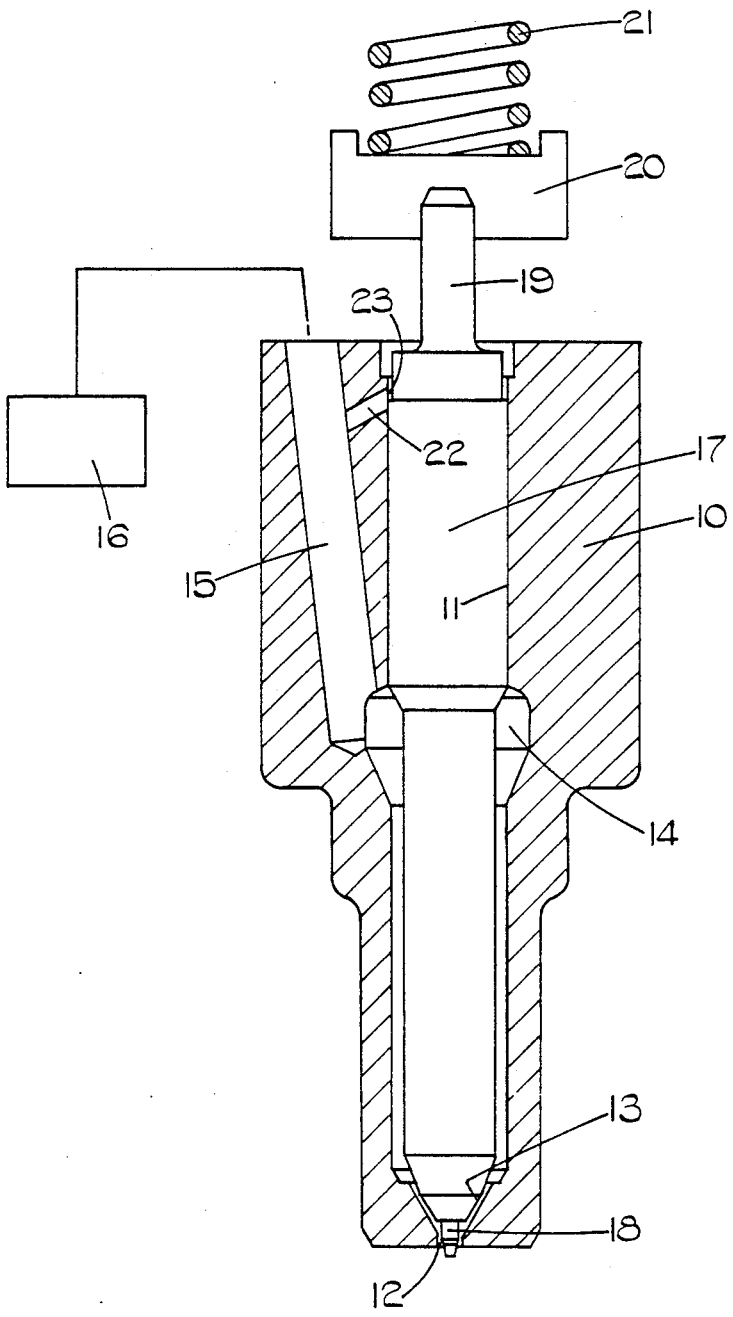
21
20
19
23
22
17
10
16
15
11
14
13
18
12

FUEL INJECTION NOZZLES

This invention relates to a fuel injection nozzle for supplying fuel to a compression ignition internal combustion engine and of the kind comprising a nozzle body, a bore defined in the body, an outlet at one end of the bore, a seating defined in the bore adjacent said outlet, a valve member slidable in said bore, said valve member being shaped for co-operation with said seating, resilient means biasing the valve member into contact with the seating, a fuel supply passage in the body, said passage communicating with said bore, and the valve member defining a surface against which in use, fuel under pressure in said passage can act to lift the valve member from the seating thereby to allow fuel flow from the supply passage through said outlet.

Such nozzles are well known in the art and in use the fuel supply passage is connected to the outlet of a fuel injection pump which delivers fuel at high pressure in timed relationship with the associated engine. For smooth running of a compression ignition engine it is desirable particularly when the total volume of fuel delivered to the engine is low as for example under light load conditions, that the injection period should be prolonged. In general, pumps of the kind utilised to supply fuel to a compression ignition engine are of the type in which the period of fuel delivery depends upon the amount of fuel to be delivered. Most of the pumps are cam actuated and while it is possible to so design a pumping flank of the cam lobe or lobes and to use different parts of the flank to obtain different rates of delivery, the pump and associated controls are not easy to design and put into practice.

The object of the present invention is to provide a fuel injection nozzle of the kind specified in a form in which the injection period of fuel to the associated engine can be prolonged.

According to the invention a fuel injection nozzle of the kind specified comprises a variable area restrictor in a flow passage extending from said supply passage to a drain, the degree of restriction offered by said restrictor being dependent upon the axial position of the valve member in the bore, the flow area of the restrictor decreasing as the valve member moves away from the seating.

An example of a fuel injection nozzle in accordance with the invention will now be described with reference to the accompanying diagrammatic drawing.

Referring to the drawing the nozzle comprises a stepped nozzle body 10 which in use, is secured to one end of a holder by means of a cap nut. The narrower end of the body extends into a combustion chamber of the associated engine.

Formed in the nozzle body is a bore 11 which at its end which opens onto the narrower end of the body, defines an outlet 12 of reduced diameter. The bore adjacent the aforesaid end also defines a seating 13 and intermediate the ends of the bore there is defined an enlargement 14 which is connected to a fuel supply passage 15. The passage 15 communicates with a further passage formed in the holder and in use, this passage is connected to the outlet of a fuel injection pump shown at 16. In practice there may be further passages 15 spaced about the axis of the nozzle to balance the flow of fuel into the enlargement 14.

Slidable within the bore 11 is a valve member 17 the valve member having an end shaped to co-operate with the seating 13. The valve member between the aforesaid end and the enlargement 14, is of reduced diameter to define an annular space between the bore and the valve member through which fuel can flow from the enlargement to the outlet 12. The valve member because of the reduction in its diameter, defines an area which is exposed within the enlargement 14 against which fuel under pressure supplied through the passage 15 can act to lift the valve member away from the seating.

At its end adjacent the seating the valve member is provided with a shaped extension 18 which extends through the outlet 12 and which as the valve member moves away from the seating alters the effective area of the outlet.

At its opposite end the valve member is provided with a reduced portion 19 which mounts a spring abutment 20, this forming an abutment for one end of a coiled compression spring 21 which acts upon the valve member to bias the valve member into contact with the seating 13. The spring and the abutment are located within a chamber defined in the aforesaid holder and the chamber is connected with a drain.

A flow path is defined between the passage 15 to the chamber and therefore the drain, by way of a short passage 22 extending from the passage 15 and opening into the bore 11 at a port 23. The remaining portion of the flow passage is defined by the aforesaid chamber. The port 23 in conjunction with the valve member 17, constitutes a variable restrictor the flow area of which reduces as the valve member moves away from the seating. If the nozzle has more than one passage 15 additional passages 22 may be provided.

In operation, when fuel under pressure is supplied to the passage 15 by the pump 16 a flow of fuel will occur through the port 23. However, the pressure in the enlargement 14 will increase to a value sufficient to lift the valve member against the action of the spring 21. As the valve member lifts away from the seating 13, fuel will start to flow through the outlet 12 which forms in effect a variable restrictor. As the valve member lifts away from the seating there will be an increased area against which the fuel under pressure in the passage 15 can act. Moreover, the valve member continues to move away from the seating, the area of the outlet 12 will increase but at the same time the area of the port 23 will decrease and with continued movement of the valve member may decrease to zero. The flow of fuel which occurs through the port 23 represents a loss in the volume of fuel delivered by the pump and therefore for a given volume of fuel required to flow through the outlet 12 an extra volume of fuel must be delivered by the pump. The period of fuel delivery will therefore be increased. Moreover, the rate of pressure rise in the enlargement 14 is more gradual than in a conventional nozzle and the initial rate of delivery of fuel through the outlet 12 will be reduced as compared with a nozzle in which the variable restrictor is absent. The extension of the injection period of fuel to the associated engine is more pronounced when the amount of fuel to be supplied to the engine is low as for example under light load running conditions. At low lift as much as 50% of the fuel delivered by the pump can flow through the port 23.

I claim:

1. A fuel injection nozzle for supplying fuel to a compression ignition internal combustion engine and of the kind comprising a nozzle body, a bore defined in the body, an outlet at one end of the bore, a seating defined in the bore adjacent said outlet, a valve member slidable in said bore, said valve member being shaped for co-operation with said seating, resilient means biasing the valve member into contact with the seating, a fuel supply passage in the body, said passage communicating with said bore, and the valve member defining a surface against which in use, fuel under pressure in said passage can act to lift the valve member from the seating thereby to allow fuel flow from the supply passage through said outlet, characterized by a variable area restrictor in a flow passage extending from said supply passage to a drain, said variable area restrictor being constituted by a port in said flow passage opening into said bore and the valve member, said port being progressively covered by said valve member as the valve member is lifted from its seating, whereby the degree of restriction offered by said restrictor is dependent upon the axial position of the valve member in the bore and the flow area of the restrictor decreases as the valve member moves away from the seating.

* * * * *